US005461208A

United States Patent [19]

McKenna

[11] Patent Number: 5,461,208

[45] Date of Patent: Oct. 24, 1995

[54] COMPACT HIGH PRESSURE SNAP-ACTING SWITCH

[75] Inventor: Andrew J. McKenna, Gotenba, Japan

[73] Assignee: Texas Instruments Incorporated, Dallas, Tex.

[21] Appl. No.: 214,471

[22] Filed: Mar. 16, 1994

[30] Foreign Application Priority Data

Mar. 24, 1993 [JP] Japan ..... 5-089418
Nov. 4, 1993 [JP] Japan ..... 5-298892

[51] Int. Cl.[6] ..... H01H 35/34

[52] U.S. Cl. ..... 200/83 J; 73/745; 200/302.1

[58] Field of Search ..... 73/717, 723, 745; 307/118; 91/1; 92/5 R; 340/611, 626; 200/83 R, 83 B, 83 J, 83 W, 83 P, 83 Y, 302.1, 82 R

[56] References Cited

U.S. PATENT DOCUMENTS 3,302,269 2/1967 Cooper et al. .
4,091,249 5/1978 Huffman .
4,356,365 10/1982 Siiberg ..... 200/83 J
4,469,923 9/1984 Charboneau ..... 200/83 B
4,495,389 1/1985 Place . .
4,644,116 2/1987 Miyakawa ..... 200/83 J
4,794,214 12/1988 Sanford ..... 200/83 J
5,153,396 10/1992 Cummings .

FOREIGN PATENT DOCUMENTS 0517674 12/1992 European Pat. Off. .
2513313 3/1983 France ..... 200/83 J
2663781 12/1991 France .

*Primary Examiner*—Gerald P. Tolin
*Attorney, Agent, or Firm*—Russell E. Baumann; Richard L. Donaldson; René E. Grossman

[57] ABSTRACT

A pressure switch particularly adapted for use with high pressure fluid is shown having a frusto-conical support surface in the form of a protuberance (121, 121') formed at the center of a surface of a piston guide member (12, 12'). A stretchable diaphragm cap member (14, 14') generally in the shape of an inverted V is closely fitted on the protuberance (121, 121') of the piston guide member (12, 12') as well as the head (111*b*) of a piston member (111, 111') received in and projecting out of bore (120, 120'*a*) formed centrally through protuberance (121, 121'). The outer thickened peripheral berm (143, 14'*a*) of the cap member (14, 14') is inserted into a recess (102*e*, 102'*e*) in the wall defining an enlarged portion of the bore (102) which in turn opens to a cavity (103, 103') of the upper housing (10, 10') in which piston guide member (12, 12') is disposed. The cap member (14, 14') serves to seal the fluid passage side of the switch from the remainder of the switch. In several embodiments a ring (40, 400, 410) is placed between the cap member (14, 14') and the conical support surface (121, 121') to reduce sliding friction and to prevent extrusion of the cap member material into a gap formed between the piston member (111, 111') and the piston guide bore (120).

24 Claims, 8 Drawing Sheets

COMPACT HIGH PRESSURE SNAP-ACTING SWITCH

BACKGROUND OF THE INVENTION

This invention relates generally to pressure switches and more particularly to pressure switches particularly adapted for use with high pressure fluid for actuating a switch mechanism in response to changes in fluid pressure being monitored.

There has been in recent years marked technical progress in the field of pneumatic and hydraulic systems which has led to the need for the development of a small sized, durable and high reliability pressure switch capable of withstanding high fluid pressure. In the field of braking systems and power steering systems for the automotive industry in recent years, for example, there has been a demand for the development of a pressure switch adapted for use with high pressure fluid, small in size, light in weight, with improved safety and highly reliable for an extended period of time for the purpose of achieving improved fuel efficiency.

Typical examples of pressure switches made according to the prior art include one in which a thin film type of flexible diaphragm is displaced in response to fluid pressure with the contact of a switching mechanism being actuated by the displacement of this diaphragm. Another example is one in which the peripheral edge of a diaphragm, in the form of a metallic disc, is fixed to a housing by such means as welding, the center of the diaphragm being moved between convex and concave configurations by the pressure differential between the two sides of the disc, with the contact of the switching mechanism being actuated in response to the disc movement.

The pressure switch of the latter type is such that the diaphragm serves both as a fluid seal and as a component part that carries out the actuating movement.

However, a problem is associated with the former pressure switch described above in that a high stress is generated locally in the diaphragm, thereby markedly reducing the life of the diaphragm. With respect to the latter type described above, welding of the peripheral portion of the diaphragm results in a possibility for the attachment operation to adversely affect the reliability of the switch. Further, extra effort and time are required in manufacturing, thereby creating a problem in terms of production.

There is an additional problem with either of the above switches in that their reliability can not be satisfactorily ensured when used with high fluid pressure, for example, in the range between 100 and 200 kilograms per square centimeter as is required in the case of the latest high pressure type pressure switches, even though they are capable of carrying out ordinary switching action when used with comparatively low fluid pressures, for example, in the range between 35 and 75 kilograms per square centimeter.

In the case of the pressure switches according to the prior art as described above when used with high pressure, it has been necessary in the past to increase the thickness of the components as well as the size of the member supporting the diaphragm in order to withstand the heavy loads that are added repeatedly when the fluid pressure becomes higher and the force applied to the diaphragm becomes extremely large.

Yet another example of prior art pressure switches employs a ring-shaped support placed under the diaphragm to limit the displaced portion of the diaphragm to the central part facing a central opening of the support. According to this construction, however, especially when used with high pressure fluids, a large localized stress is generated in the diaphragm at the edge of the central opening of the ring-shaped support when the diaphragm is displaced with a consequent result that the diaphragm tends to be adversely affected, thereby shortening the life of the diaphragm and consequently the life of the switch itself.

A pressure switch using a diaphragm or cap made of rubber has also been proposed. However, the rubber hardens in low temperature environments, becoming relatively rigid and thus seriously affecting the switching function. In addition, a diaphragm made of rubber tends to be easily worn out at the portions of engagement with the movable member of the switch mechanism. This presents a further problem in that, because of this wear, the interior of the switch mechanism can become contaminated thereby shortening the life of the switch.

SUMMARY OF THE INVENTION

It is an object of the invention to provide a pressure switch particularly useful with high pressure fluids which is small in size, light in weight, with a small number of component parts, simple in construction, easily produced and assembled, and which can ensure high efficiency even in low temperatures, and which has a long useful life and high reliability, capable of actuation using a small force even when used with high pressure fluid.

In accordance with the invention, a pressure switch comprises a piston member arranged to be movable in dependence upon the fluid pressure received in a passage way of a port fitting and a piston guide member for guiding the movement of the piston member. A frusto-conically shaped protuberance, generally in the shape of an inverted V which tapers from its apex outwardly toward the sidewall of a fluid passage is formed at the center of a surface of the piston guide member. A stretchable diaphragm or cap member, generally conical in the shape of an inverted V, is closely received over the protuberance of the piston guide member and the end of the piston member. The thickened outer peripheral berm of the cap member is inserted into an annular recess formed in the wall defining the passage in the port fitting and adjacent to the protuberance thereby forming a seal preventing fluid flow from the fluid passageway side to the piston guide member side including the piston member.

The cap member is made of elastomeric material having sufficient stretchability and flexibility to enable it to follow the movement of the piston member when it moves in response to the rising and lowering of the fluid pressure and to allow it to be elastically deformed to conform to the shape of an end of the piston member and the frusto-conical shape of the protuberance of the piston guide member.

The cap member is tubular but generally conical in configuration in the form of an inverted V having a prescribed apex angle but with its head portion being generally curved in the shape of an inverted U that receives and transmits fluid pressure to the end face of the head of the piston member. The cap member has an intermediate wall portion which extends from the head portion at the apex angle and which is adapted to slidingly move toward the base of the protuberance in conformance with the inclined frusto-conical surface of the protuberance of the piston guide member when exposed to a fluid pressure above a prescribed value. The outer end of the intermediate wall portion is formed with a thickened outer peripheral annular berm which is received in the annular recess formed in the wall defining the fluid passage in the fitting spaced from the outer periphery of the protuberance to seal the passage side from the piston guide member side. The berm is further compressed into the recess when the fluid pressure above the prescribed value occurs to enhance the sealing action.

According to a feature of the invention, the apex angle is selected so that the length of the intermediate wall portion is long relative to the outer diameter of the berm.

According to another feature of the invention, if desired, a ring-shaped member having a low frictional coefficient can be placed between the cap member and the frusto-conical surface of the protuberance of the piston guide member. According to this feature the sliding frictional resistance is reduced when the intermediate wall of the cap member slides along the inclined surface of the protuberance.

According to another feature of the invention a second diaphragm made of an elastic material or a high strength flexible film is interposed between a seating member that receives a pressure responsive disc member and the opposing face of the piston guide member. An elastomeric sealing member such as an O-ring is provided between the inner wall of the fitting defining the cavity in which the seating member is disposed and the seating member on one side and the second diaphragm on the other side to form a second fluid seal to prevent fluid flow between the piston member and the pressure responsive disc member as well as between the exterior of the switch housing and the interior and the cavity. According to this embodiment, essentially the entire surface of the diaphragm is supported by the surfaces of the pressure responsive disc member and the seating member during the period of the pressurized action of the fluid pressure.

According to yet another feature of the invention the switch mechanism is formed by first and second electrically conductive metal terminals and a movable spring arm has one end attached to one of the terminals with a movable contact mounted at its opposite free distal end. The movable arm has an integrally attached motion transfer or operating arm extending upwardly therefrom intermediate its two ends. The movable contact is adapted to move into and out of engagement with a stationary contact that has been provided on the other of the two terminals and the distal free end of the operating arm is aligned with and adapted to be biased against the center of the pressure responsive disc member.

The movable spring arm is flexibly moved in dependence upon movement from the pressure responsive disc that has been transmitted through the operating arm when the pressure responsive disc member has actuated from one dished configuration to its oppositely dished configuration in response to the movement of the piston member, thereby closing or opening the gap between the movable and stationary contacts.

According to another feature of the invention, all of the pressure sensing components, that is, the piston member, the piston guide member, the cap member, the pressure responsive disc member and the pressure responsive disc seating member are secured together into a unit, thereby providing a sub-assembly of a pressure operating mechanism in an upper housing, while an electrical switch mechanism comprising the first and second terminals, the movable spring arm and the stationary and movable contacts are integrally incorporated into a lower housing, thereby constituting a sub-assembly of the switch mechanism. An annular-shaped peripheral wall extends downwardly from the upper housing to a distal end portion which is bent inwardly to capture the outer peripheral part of the lowermost component of the pressure operating mechanism sub-assembly. Provision of separate pressure sensing and electric switch sub-assemblies provides the advantage of being able to separately test each sub-assembly as separate units.

An annular peripheral wall also extends downwardly from the outer peripheral edge of the seating member with the lower portion of the wall being bent inwardly to capture and secure an upper flange part of the lower housing. A sealing member such as a gasket is provided between the seating member and the upper flange part of the lower housing, thereby sealing the interior of the lower housing from the exterior and protecting the switch mechanism inside.

When the fluid pressure of the system rises, the pressure of the fluid acts on the cap member, with a result that a compressive force commensurate with the product between the fluid pressure and the area of the cross section of the end face of the piston member will be added to the piston member through the cap member. Because of the compressive force, the piston member tends to move in a direction guided by the piston guide member with a compressive force being transmitted from the other end face of the piston member to the pressure responsive disc member.

When the compressive force that has been transmitted from the piston member reaches the actuation level of the pressure responsive disc member, the disc member actuates and moves from the first dished configuration to the oppositely dished configuration, followed by the piston member. In dependence upon this actuation, the movable contact of the switch mechanism moves into or out of engagement the stationary contact.

When the fluid pressure of the system falls, the compressive force that is transmitted from the piston member is reduced. When this compressive force reaches the return actuation level of the pressure responsive disc member it actuates and moves from second configuration back to the first configuration with the movable contact returning to its previous engaged or disengaged position. When the disc member actuates and moves to the first configuration, the piston member moves and returns in a direction which is opposite to that which has been described above.

The cap member remains in close engagement with the head of the piston member and the protuberance of the piston guide member in conformance with the shape of the head of the piston member and the frusto-conical shape of the protuberance of the piston guide member. When the fluid pressure rises the fluid pressure is transmitted to the end face of the piston member through the cap member. At the same time, the cap member elastically deforms or stretches in conformity with the moving action of the piston member when it moves because of the high elasticity and high flexibility of the cap member.

For example, the head of the cap member moves along the longitudinal axis in the direction of the movement of the piston member and the intermediate wall moves, smoothly sliding, along the inclined surface of the frusto-conical shape of the protuberance.

According to a another feature of the invention, an anti-extrusion ring member can be placed in a seat formed in the upper portion of the protuberance so that it is interposed between the piston member and the cap member to help prevent extrusion of the cap member into the gap between the piston member and the bore in the piston guide member, the upper surface of the ring being tapered to match the frusto-conical surface of the protuberance to reduce sliding friction. In one embodiment the piston member is inserted into the ring member using an interference fit to provide zero clearance to effectively prevent extrusion. In another embodiment the ring is selected so that it has a gap with the piston and the tapered surface is adapted to flex inwardly toward the piston member to close the gap when subjected to fluid pressure. In yet another embodiment, the ring member is split allowing the bore of the ring to contract when subjected to fluid pressure.

The head of the cap member is in close engagement with the end of the piston member and the upper part of the frusto-conical protuberance. In addition, the intermediate wall is in close engagement with the inclined surface of the protuberance and the outer peripheral berm is compressed between the piston guide member and the housing. Furthermore, increased fluid pressure further compresses the berm into the recess in the wall member of the housing thereby adding to the effectiveness of the seal. The cap member not only serves to transmit the fluid pressure but also to seal the fluid passage side from the piston guide member including the piston member and the pressure responsive disc member. The cap member has high elasticity and flexibility and flexibly deforms and moves in dependence upon the action of the pressure sensing member, with a result that the transmission of the fluid pressure and the fluid seal can be carried out accurately for a long period of time by means of the shape of the protuberance formed on the piston guide member.

Since the cap member flexibly and elastically deforms in dependence upon the movement of the piston member, moreover, there is little friction or sliding resistance thereby minimizing wear or damage to the cap member itself and movable members that are adjacent to the cap member, such as the piston member.

The improved cap member and the frusto-conical protuberance makes it possible to reduce the number of component parts which have been deemed necessary around the piston member and the pressure responsive disc member in the switch construction according to the prior art, thereby realizing a compact switch mechanism with fewer component parts.

In addition, the fluid pressure acts on the head of the cap member and a small portion of the intermediate wall portion contiguous with the head, thereby enabling the transmission of the fluid pressure that has been applied to this small area to the end face of the piston member effectively. Accordingly, the high fluid pressure can be converted into a small driving force of the piston member and the switch action can be carried out accurately by using this driving force. Even in the case of a high pressure system, the load that is applied to the pressure responsive disc member can be reduced, thereby making it possible to reduce the size and thickness of the pressure responsive disc member, the member that supports the disc member or the housing. Along with the reduction of the number of component parts, this contributes toward a reduction of the size and weight of the switch construction.

According to a feature of the invention, a movable spring arm is provided on one terminal of the switch mechanism and an operating arm that integrally extends upwardly from the arm intermediate its opposite ends is used to transfer motion to and from the pressure responsive disc member to directly move the spring arm in conformity with the movement of the disc member, with the movable contact that has been provided on the arm moving into and out of engagement with the stationary contact of the other terminal. As a result, the accessory mechanisms for guiding and supporting a conventional rod and pin, as well as the rod and pin used for transferring motion are no longer needed. Thus, it becomes possible to further reduce the number of the parts and the space required. Because of the elimination of the rod and pin and their supporting mechanism, there will be no wear or damage caused by their sliding movement.

According to a modified embodiment, a motion transfer pin is mounted on a support placed between the piston member and the pressure responsive disc member and the second diaphragm is disposed between the piston member and the pin. The surface area of the pin is selected to be larger than the head of the piston so that in the event of fluid leakage through the cap member the fluid pressure acting on the increased surface area of the pin will cause it to actuate the disc member and open a normally closed switch at pressure levels lower than the prescribed level to provide a fail safe mode.

These and other features of the present invention and the attendant advantages will be readily apparent to those having ordinary skill in the art and the invention will be more easily appreciated from the following detailed description of the preferred embodiments of the present invention taken in conjunction with the accompanying drawings, wherein like reference characters represent like parts throughout the several views.

DESCRIPTION OF THE PREFERRED EMBODIMENTS

Figure 1:
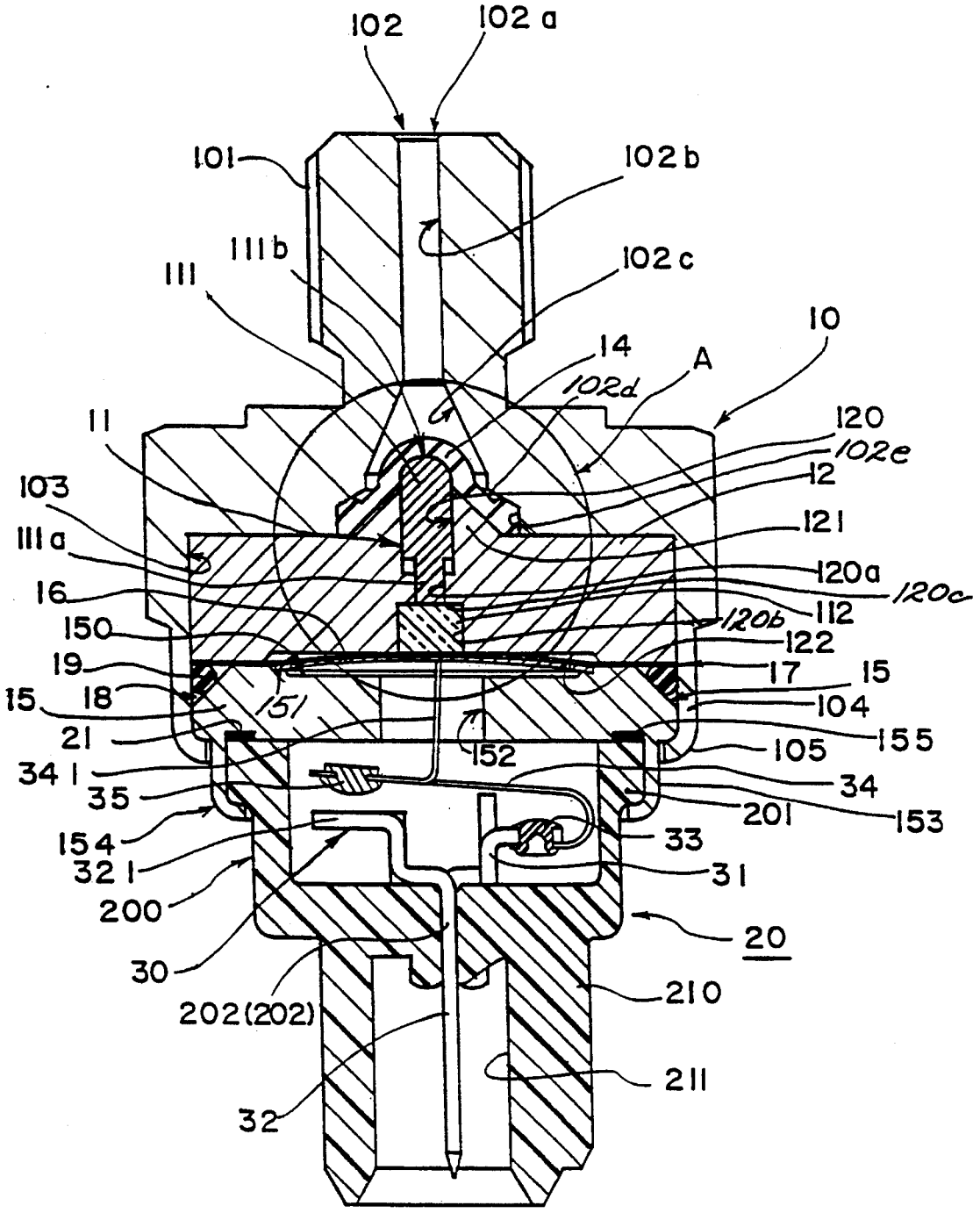
FIGS. 1 and 2 are cross sectional views of a pressure switch made in accordance with invention showing a switch in the non-actuated and actuated conditions respectively.
Figure 2:
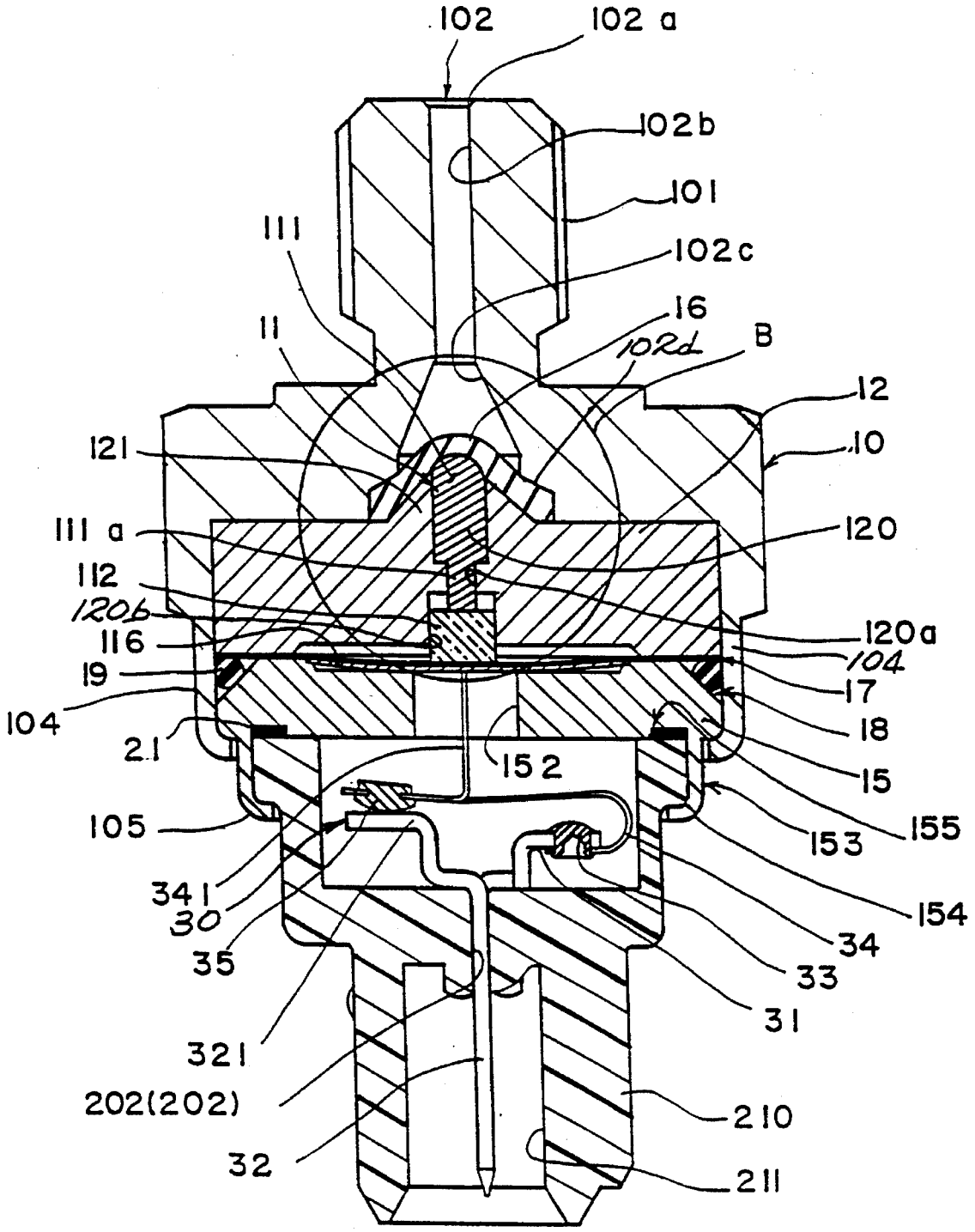

With particular reference to FIGS. 1 and 2, the housing for a pressure switch made in accordance with the invention comprises a combined upper housing or port fitting 10 made of any suitable material such as stainless steel and lower housing 20 preferably made of electrically insulating material such as plastic.

The body portion of the upper housing is preferably formed in a hexagonal shape with the head or port portion in the shape of a rod, with a thread 101 being formed on its outer peripheral surface. A bore 102 is formed along a longitudinal axial direction to form a fluid passageway at the center of the upper housing 10. The bore 102 comprises a chamfered entrance part 102*a*, a fluid inlet passage 102*b* which conveniently extends uniformly with the same diameter into the interior of the housing from the entrance part 102*a* into an enlarged passage 102*c* which expands in a tapered manner from passage 102*b* to the interior. The enlarged passage 102*c* leads to a cavity 103 having an even greater diameter and formed in such a way as to open downwardly. A sidewall or skirt 104 depends downwardly from the body to define the sidewall of cavity 103.

A second outwardly tapered part 102*d* is formed at the lower portion of region 102*c* in communication with cavity 103. The angle of the taper of part 102*d*, i.e., its incline is selected to be smaller than the angle of the incline of the protuberance 121 which will be described below. The outer peripheral berm of the cap member 14, also to be described below, is inserted into an annular recess 102*e* that is formed between the tapered part 102*d* and the protuberance 121.

A piston guide member 12 for guiding the piston means 11 is disposed at the top portion of cavity 103 of the upper housing 10. A guide bore 120 is formed along the longitudinal axis through piston guide member 12 at the center thereof. The piston means 11 comprises a piston member 111 slidably inserted into guide bore 120 movably along the longitudinal axis of the bore. A stop surface 120*c* is formed by a small diameter bore 120*a* formed midway in the guide hole 120 and which extends to a larger diameter bore 120*b* which in turn extends to the bottom surface of guide member 12. Piston means 11 also comprises a pin 112 disposed adjacent to and below piston member 111. A small diameter portion 111*a* that has been formed on the lower part of the piston member 111 is inserted into the small diameter bore 120*a* of the guide hole 120 and pin 112 is slidably received in bore 120*b*. The diameter of pin 112, being larger than the diameter of bore 120*a*, limits upward movement of pin 112.

Downward movement of piston member 111 as seen in FIG. 2, is limited by the engagement of the shoulder formed between the two diameter portions of piston member 111 and the stop surface 120*c* formed by bore 120*a* thereby effectively preventing transmittal of any overload accompanying the rise of the fluid pressure to the pressure responsive disc member 16. When the piston member 111 has moved higher as seen FIG. 1, the upper end face of pin 112 is limited by the lower shoulder 120*d* of the small diameter hole 120*a*.

The central portion of the upper surface on the fluid passage side of piston guide 12 projects upwardly from the main body portion of guide member 12, tapered to form a frusto-conical protuberance 121, i.e., in the shape of an inverted V. Guide hole 120 extends through the top of protuberance 121. The length of piston member 111 is selected so that head 111*b* of piston member 111 projects out of the top of protuberance 121. When piston member 111 is exposed to an elevated level of fluid pressure and moves to the position shown in FIG. 2, the distance that head 111*b* of piston member 111 projects beyond protuberance 121 is accordingly reduced by that amount.

A diaphragm or cap member 14 which has been formed generally conically in the shape of a an inverted V is closely fitted to protuberance 121 of piston guide member 12 as well as head 111*b* of the piston member 111.

Cap member 14 is formed of material having high stretchability or elasticity such as, for instance, EP (ethylene propylene), EPDM (ethylene propylene diene monomer), or some other elastomer by means of resin molding. Cap member 14 is integrally formed with a head part 141 (see in particular FIGS. 5, 6) generally U shaped which is fitted to head 111*b* of piston member 111, an intermediate wall 142 which extends from head 141 at an angle which causes it to cover the inclined surface of the protuberance 121 and an outer, preferably thicker, annular berm 143 that has been formed on the outer periphery of intermediate wall 142.

Cap member 14 has high flexibility and is elastically deformed in response to movement of piston member 111. When the fluid pressure of the system rises, head 141 of cap member 14 receives the fluid pressure and transmits the pressure to head 111*b* of piston member 111 and, at the same time, moves and deforms in the same direction along with movement of piston member 111 when piston member 111 moves in response to the fluid pressure. In addition, intermediate wall 142 moves slidingly downwardly on the frusto-conical surface in the direction of the outer periphery of the protuberance conforming to the inclined frusto-conical surface.

The outer peripheral berm 143, having been inserted into the recess 102*e*, seals the gap between the inner wall of the upper housing 10 and the piston guide member 12. At the same time, a shoulder 144 of the berm 143 receives fluid pressure when the fluid pressure has risen and further compresses the berm into the recess 102*e*, thereby enhancing the sealing effect.

The angle that the intermediate wall 142 forms with head 141 is selected so that the length of the intermediate wall 142 is relatively long while maintaining the outer diameter thereof or the diameter of the outer peripheral berm 143 relatively small in order to minimize forces on the internal components.

Disc seating member 15 is disposed under piston guide member 12 in the lower part of cavity 103 of upper housing 10 surrounded by the sidewalls 104. On the mutually opposing surfaces of the disc seating member 15 and the piston guide member 12, dished shaped recesses 150 and 122 are respectively formed to provide a space for the pressure responsive disc member 16 to move between opposite dished configurations within the two recesses 150 and 122. The outer peripheral edge of pressure responsive disc member 16 is supported on a step 151 formed at the outer peripheral edge of recess 150 of the disc seating member 15. The pressure responsive disc member preferably is a snap action disc 16 formed as a curved surface having a selected curvature from spring material, such as stainless steel, and is caused to change dished configurations with a snap action between a first upwardly convex configuration with the center being curved upwardly as shown in FIG. 1 and a second upwardly concave configuration with the center curved downwardly as shown in FIG. 2.

Pin 112 of the piston means 11 is biased against the surface of the center of the snap action disc 16 through a flexible diaphragm 17. Diaphragm 17 is formed of suitable material such as a high elastic, high polymer EP, EPDM or a high strength film material as PEEK (poly ether ether ketone). The outer peripheral part of diaphragm 17 is held between the outer perimeter portion of piston guide member 12 and the outer perimeter portion of disc seating member 15.

The material chosen for diaphragm 17 is selected to be compatible with the operating fluid of the system such as the aforementioned EP, EPDM or PEEK, which can be used with brake fluid. The diaphragm is supported essentially throughout its surface area by snap action disc 16 and disc seating member 15. Because of this, the stress that is produced in the diaphragm 17 is minimized.

The outer top peripheral edge of disc seating member 15 is recessed at 18 having an inclined surface 156 and a sealing member such as an O-ring 19 is placed in recess 18 between the inner surface of the sidewall 104 of the upper housing 10 and the outer peripheral portion of the lower surface of the piston guide member 12. Diaphragm 17 and O-ring 19 serve as a secondary, redundant sealing means to back-up the seal of cap member 14 so that even if the seal of the cap member 14 were to be broken and the operating fluid were to leak past cap member 14 and enter through a gap between piston member 111 and guide hole 120 of the piston guide member 12 or the gap between the outer periphery of piston guide member 12 and the inner wall of upper housing 10, flow of the operating fluid would be prevented by diaphragm 17 and O-ring 19 from entering the switch chamber in lower housing 20 thereby optimizing the sealing function. The redundant sealing feature is particularly advantageous when used in a system in which the leakage of the operating oil would have an extremely serious effect such as the braking system of an automobile.

In addition, the O-ring prevents external contaminants such as water from entering the switch chamber from the outside environment through the gap between the inner face of the sidewall 104 of the upper housing 10 and the upper surface of the disc seating member 15.

The lower distal free end of the sidewall 104 of the upper housing 10 is bent inwardly at 105, preferably throughout its entire periphery capturing and securing the lower peripheral outer edge of the disc seating member 15. An aperture 152 is formed through disc seating member 15 at the center thereof. A sidewall 153 extends like a skirt around the outer periphery of the lower surface of the disc seating member which is bent inwardly at 154 to capture and secure a flange 201 that has been formed at the top of the lower housing 20.

An annular recess 155 is formed on the lower surface of disc seating member 15 inwardly of the sidewall 153 and a gasket 21 is inserted therein to prevent leakage between flange 201 and the lower surface of the disc seating member 15.

Lower housing 20 is formed by a body 200 having flange 201 at the top thereof and a terminal section 210 that has been formed at the lower part thereof. Body 200 is formed with a switch chamber that is open at the top and slots 202 and 202 communicating with terminal recess 211 of the terminal section 210 provided centrally in the wall bottom. The recess 211 of the terminal section 210 is downwardly open.

A switch mechanism 30 is disposed within lower housing 20. Switch mechanism 30 comprises two metallic terminals 31 and 32 that have been inserted into respective slots 202 and 202 and a generally J-shaped movable spring arm 34 having one end connected to the distal end of the top of one terminal 31 by means of a rivet 33 and the other end extending away and then back toward the upper end of the other terminal 32.

Terminals 31 and 32 extend through slots 202 into terminal recess 211 of the terminal section 210 as stated above. A stationary contact 321 is provided at the upper end of terminal 32. Movable spring arm 34 is formed from an electrically conductive metallic spring plate material, with a movable contact 35 being mounted at the distal end thereof. Movable spring arm 34 has a generally V shaped configuration with movable contact 35 moving into engagement or disengagement with stationary contact 321 of the other terminal 32 thereby opening or closing the gap between terminals 31 and 32.

Intermediate the opposite ends of spring arm 34 an operating arm 341 extends upwardly therefrom generally coaxially with the piston means 11 through aperture 152 of disc seating member 15 with its distal free end being pressed against the central portion of the lower surface of snap acting disc 16.

Operating arm 341 directly transmits the movement of the snap acting disc 16 to movable spring arm 34 and elastically moves arm 34 so that movable contact 35 engages or disengages with stationary contact 321.

It will be understood that rivet 33 may be omitted, if desired, by such means as integrally forming a rivet-shaped connective part at the edge of the top of one of the terminals 31 and fixing one end of the movable spring arm 34 to this connective part or directly connecting the same to terminal 31 by means of welding or the like.

Figure 3A:
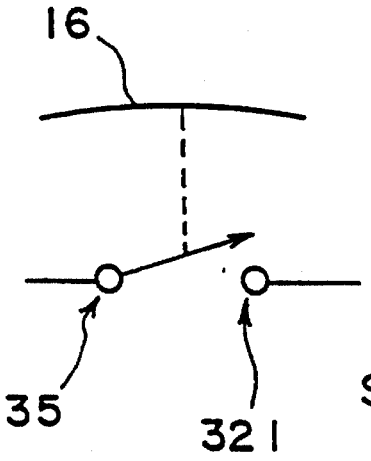
FIGS. 3(*a*) and 3(*b*) show schematics of a normally open electrical switch, as seen in FIGS. 1 and 2, in the contacts disengaged and contacts engaged positions, respectively.
Figure 3B:
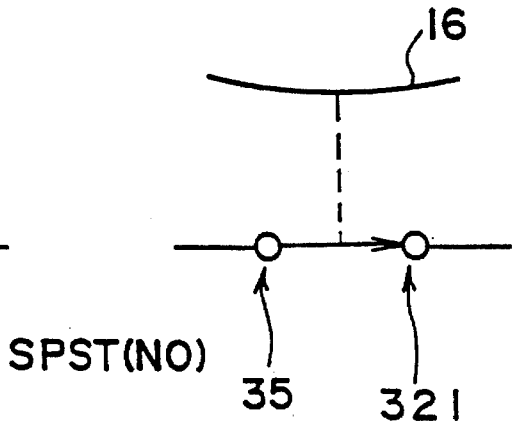

In the pressure switch described, movable contact 35 is disengaged with stationary contact 321, as depicted in FIG. 3(*a*), when snap action disc 16 is in the FIG. 1 configuration thereby providing an open state of the switch. When the snap action disc snaps and moves to the second configuration shown in FIG. 2, movable contact 35 is in engagement with stationary contact 321 as is depicted in FIG. 3(*b*), thereby bringing about a closed state.

In other words, the pressure switch according to the described embodiment is of a normally open (NO) contact type whereby the contacts 321 and 35 are out of engagement with one another as shown in FIG. 3(*a*) when the pressurization force applied to the snap action disc 16 is less than a prescribed level, i.e., when the fluid pressure is lower than the set value, thereby resulting in an open state.

Figure 4A:
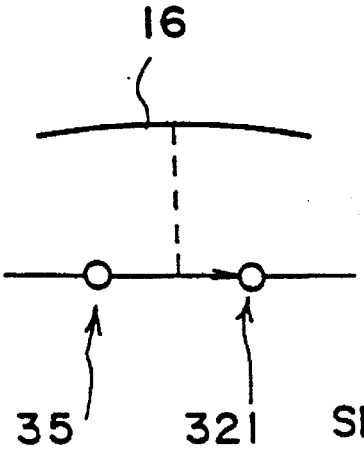
FIGS. 4(*a*) and 4(*b*) show schematics, similar to FIGS. 3(*a*) and 3(*b*), of a normally closed electric switch in the contacts engaged and disengaged positions, respectively.
Figure 4B:
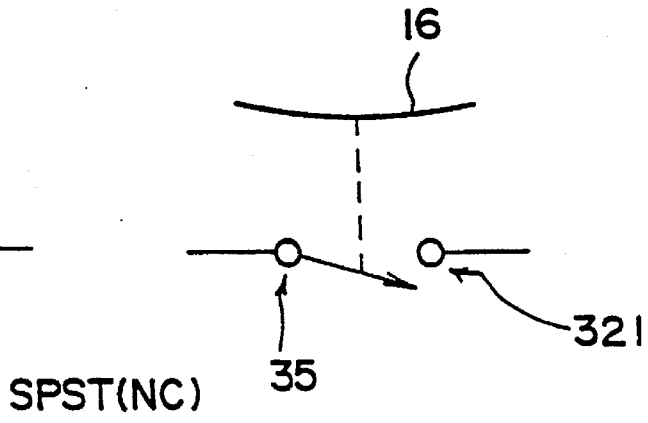

However, it is also possible to provide a switch mechanism 30 so that the contact opening and closing action is reversed relative to that which has been described above. For example, it is possible to adopt the switch structure of the normally closed (NC) contact type whereby both contacts 35 and 321 are in engagement as shown in FIG. 4(*a*), providing a closed switch state at fluid pressures below the set value and when the snap action disc 16 is actuated on higher pressure moves to an open switch state as shown in FIG. 4(*b*) with the disc in the second configuration shown in FIG. 2. This switch structure can be easily realized merely by reversing the relation between the movable contact 35 and the stationary contact 321 to one which is opposite to that which has been described above.

The pressure switch made in accordance with the invention can be used with air pressure systems or oil pressure systems by screwing the thread 101 of the rod-like head of the upper housing 10 into a threaded bore (not shown in the drawings) of piping or the like. The hexagonal head of the upper housing 10 facilitates installation with a wrench. Terminals 31 and 32 of the switch mechanism 30 are then connected to the electrode terminals of the switch circuit (not shown in the drawings) through the terminal section 210 of the lower housing 20.

The air pressure system or the oil pressure system has its operating fluid received in bore 102*b* of the upper housing 10 and expanded passage 102*c* and in communication with cap member 14. The fluid pressure acts on head 111*b* of the piston member 111 through the head 141 of the cap member 14 and is converted to a force which is transmitted to the center of the snap action disc 16 from pin 112 of piston means 11 through diaphragm 17.

Figure 5:
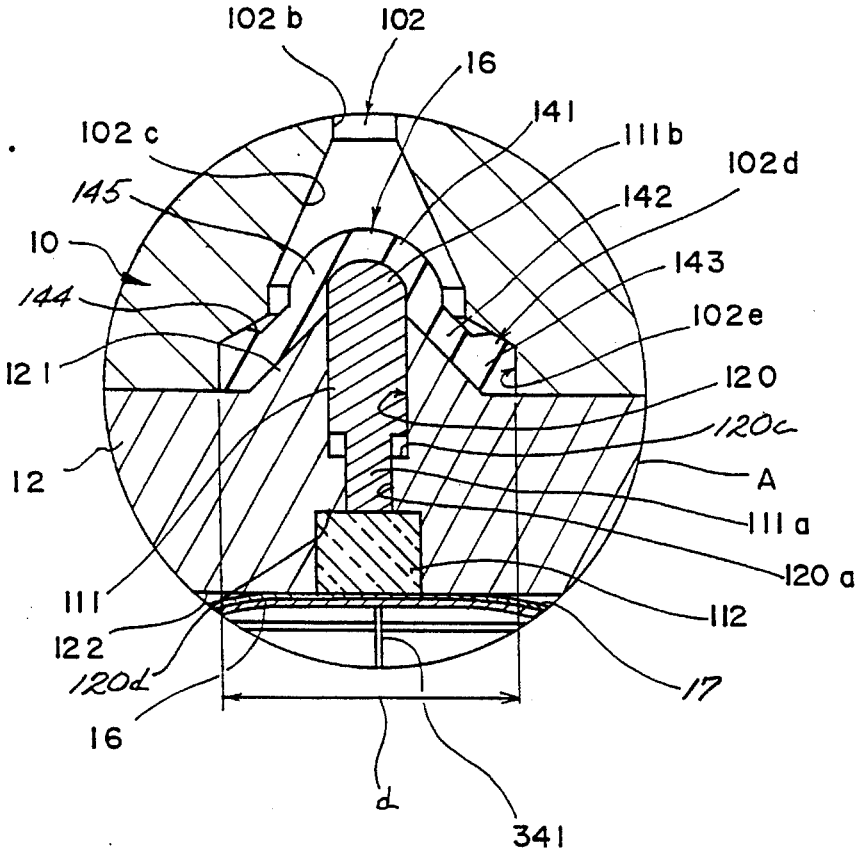
FIG. 5 is an enlarged portion of FIG. 1, identified as A.

As mentioned above, the snap action disc 16 is a spring member having a first at rest, upwardly convex dished configuration as shown in FIGS. 1 and 5 until the force that is transmitted from the pin 112 of the piston means 11 exceeds the set value or actuation level of the disc, or in other words, unless the fluid pressure exceeds the prescribed set value.

When snap action disc 16 is in the first configuration the movable spring arm 34 is in its upward position together with the operating arm 34. Because of this, the movable contact 35 that has been mounted at the distal free end of the movable spring arm 34 is disengaged with the stationary contact 321 that has been provided on the metal terminal 32. As a result of this, the circuit between terminals 31 and 32 is opened and an open switch state is maintained.

When the upper end face of the pin 112 returns upwardly to the position determined by the lower shoulder **120*d* of small diameter bore 120*a* as is shown in FIGS. 1 and 5, the head 111*b* of the piston member 111 projects a selected distance above the top of the protuberance 121 that has been formed in the piston guide member 12. Along with the movement of the piston member 111, the head part 141 of the cap member 14 moves and deforms in the same direction and is fitted closely on the entire portion of its head 111*b* that has projected from the protuberance 121 and the entire top of its surrounding protuberance 121. In this position, head 141 of the cap member 14 is elastically displaced and deformed approximately in the shape of a U conforming to the shape of the head 111*b* of the piston member 111**.

In addition, intermediate wall 142 moves slidingly upward conforming to the inclined surface of the protuberance 121 along with the deformation and movement of the head part 141 but with the outer peripheral berm 143 of the cap member 14 still maintained within recess **102*e*, with a result that the recess 102*e* is sealed by the outer peripheral berm 143. Since the inner surface of the cap member 14 is closely in contact with the entire surface of the head 111*b* of the piston member 111 and protuberance 121, the gap between the operating fluid side and the outer peripheral part side of the piston guide member 12 as well as the gap between the operating fluid side and the snap action disc 16 side including the piston means 11** is effectively sealed preventing leakage of the operating fluid to the switch mechanism.

When the fluid pressure rises, meanwhile, the pressurization force that is added from the pin 112 of the piston means 11 rises in proportion to the fluid pressure. When the fluid pressure reaches the prescribed set value, the pressurization force that is added from the piston member 112 to the snap action disc 16 reaches the preselected set value or the snap action point. Thereupon, the snap action disc 16 actuates and moves from the first configuration shown in FIG. 1 to the second configuration shown in FIG. 2.

When the snap action disc 16 actuates and moves to the second configuration indicated in FIG. 2, the force of its actuation and its movement is directly transmitted to the movable spring arm 34 from the operating arm 341. Because of this, the spring arm 34 moves downwardly and, along with this, the movable contact 35 that has been mounted at the distal free end moves into engagement with the stationary contact 321 mounted on terminal 32 as is shown in FIG. 2. Accordingly, an electrical connection between terminals 31 and 32 is formed and the switch assumes a closed state.

Figure 6:
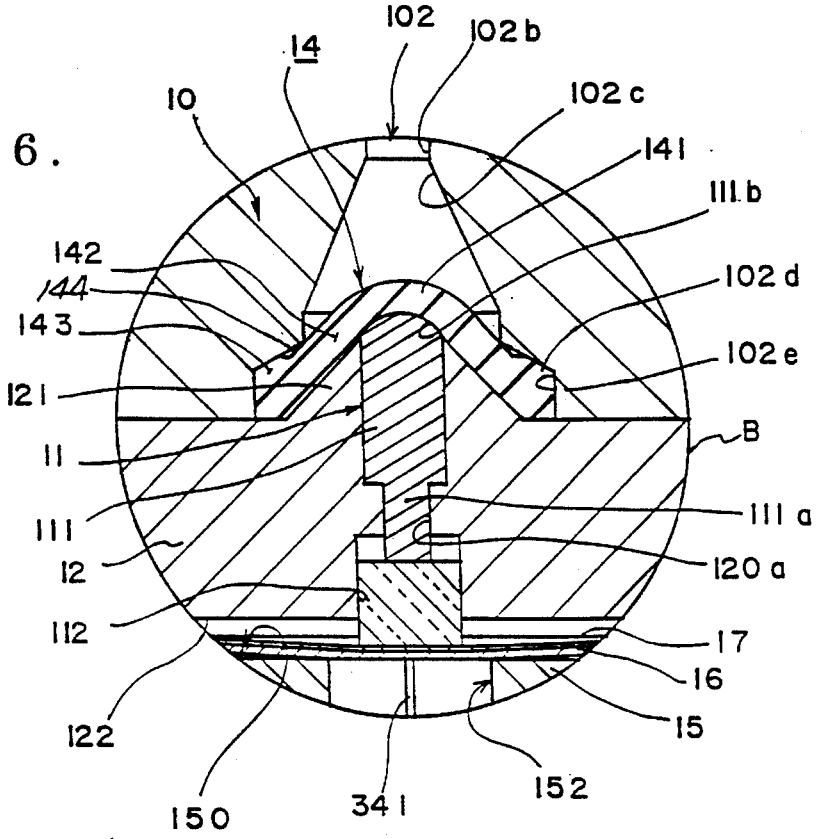
FIG. 6 is an enlarged portion of FIG. 2, identified as B.

When, further, the snap action disc 16 actuates and moves to the second configuration and the piston member 111 moves down to a prescribed location as is shown in FIGS. 2 and 6, the head part 141 of the cap member 14 moves down and displaces as is shown in detail in FIG. 6 and is deformed from the approximate shape of a U as shown in FIG. 5 into a state which is somewhat expanded outwardly. In addition, the intermediate wall 142 of the cap member 14 moves slidingly toward the base of protuberance 121 conforming to the inclined surface thereof with the downward shift of the piston member 111 caused by the elevation of the fluid pressure.

The outer peripheral berm 143 is compressed into recess **102*e* along with the elevation of the fluid pressure acting on shoulder 144, thereby enhancing the sealing action within recess 102*e***.

When the snap action disc 16 actuates and moves to the second configuration, the piston means 11 moves downwardly. The shoulder part of the small diameter shaft **111*a* of the piston member 111 is stopped by the step part or stop surface 120*c* of the small diameter part of guide hole 120, with a result that the downward movement is limited so that even if the fluid pressure that acts on the cap member 14 should become excessively large, any excessive load will not be transmitted to the snap action disc 16** and the other associated components.

When the fluid pressure thereafter falls, the pressurization force that is transmitted from pin 112 of the piston means 11 to the snap action disc 16 is reduced in proportion to the fluid pressure. When the pressurization force is reduced to the snap action reset level of the snap action disc 16 taken with the return force of spring arm 34 through the operating arm 341, the disc actuates and moves back to the first configuration shown in FIG. 1.

At the same time, the spring arm 34 elastically deforms from the position shown in FIG. 2 to an upward position shown in FIG. 1 and the movable contact 321 at its distal free end moves out of engagement with the stationary contact 321. Because of this, the circuit between the two terminals 31 and 32 is opened and the pressure switch returns to the open switch state as shown in FIG. 1.

When the snap action disc 16 actuates and moves to the first configuration, piston member 111 moves upwardly and returns to the prescribed position. Along with the actuation and movement of the snap action disc 16, diaphragm 17 deforms into an upwardly curved state conforming to the surface of the snap action disc 16.

When the piston member 111 moves upwardly and returns as described above, head **111*b* of piston member 111 again projects above the top of the protuberance 121 of the piston guide member 12 by a predetermined distance. In addition, the head 141 of the cap member 14 moves and deforms inwardly along with the upward movement and return of the piston member 111 due to a decrease in the fluid maintaining contact with the peripheral surface of the top of protuberance 121 as well as the head 111*b* as a whole of the piston member in an approximate shape of a U as is shown in FIG. 5**.

Moreover, the intermediate wall 142 moves slidingly upwardly in conformance with the inclined surface of the protuberance 121 along with the upward movement and return of piston member 111. In addition, the compressive force on berm 143 is reduced along with a reduction in the fluid pressure and is restored to the shape in FIG. 5. In this manner, the cap member 14 is displaced, deformed and returns to shape shown in FIG. 5.

As has been described above, the cap member 14 as a whole and its various portions flex and elastically move and deform in conformance with inclined surface of the protuberance 121 as modified by the different positions of the head part 111*b* of the piston member 111 in dependence upon an increase or decrease in the fluid pressure in connection with the actuation and movement of the snap action disc 16 from the first configuration to the second configuration or vice versa.

Particularly, the cap member 14 according to this embodiment, which has been formed of an elastomer whose elasticity is very high, quickly stretches without the generation of heat accompanying the dispersion of the energy upon receipt of a tensile force by the fluid pressure, and shows a high elasticity and tensile strength in the state of being fully extended. When the tension is removed due to a decrease in the fluid pressure, further it is immediately restored to its original size and shape as shown in FIG. 5.

According to this embodiment, when a compressive stress is applied to the cap member 14 due to an elevation of the fluid pressure, its head part 141 is scarcely deformed, while being displaced in the direction of the movement of the piston means 11.

In this construction wherein the intermediate wall 142 moves slidingly toward the base of the protuberance 121 conforming to the inclined surface with an elevation of the fluid pressure, the intermediate wall 142 serves to reduce the stress applied to the cap member 14 to a marked degree, thereby prolonging the durability of the cap member 14.

According to this embodiment, where the intermediate wall 142 is formed having a prescribed angle and the length of the intermediate wall 142 as compared to the cap member 14 as a whole is relatively long because of this angle and the diameter of the outer peripheral edge 143 is relatively small, the pressurization force that is applied to the various pressure action members of the main pressure switch can be further reduced. Because of this, the fluid pressure can be converted into a still smaller switch driving force, thereby making it possible to switch this pressure switch with a high fluid pressure.

According to this embodiment, further, the displacement which occurs when the piston member 111 strokes up and down and the resulting flexible sliding movement toward or away from the base along the inclined surface of the protuberance 121 of piston guide member 12 is accompanied by a reduction in friction produced between piston member 111 and cap member 14 compared to structures not having the frusto-conical surface feature along with a reduction in particulate contamination from the rubber type materials of cap member 14 produced in connection with such frictional engagement.

The provision of the frusto-conical surface of protuberance 121 along with the flexible elastic deformation and displacement of the cap member 14 as described above, serves to eliminate, or at least minimize, the phenomenon whereby a part of the cap member 14 extrudes into the gap between the guide hole 120 and the piston member 111 associated with movement of the piston member 111.

Generally speaking, when used in the low temperature environment, rubber type materials tend to become rigid and resistant to compression. In this embodiment, however, the taper design of the frusto-conical protuberance 121 allows the intermediate wall 142 to undergo some bending at point 145 (FIG. 5) as piston member 111 moves. This allows relatively normal operation at low temperatures and minimizes any effect on switching set points.

Inasmuch as the lower peripheral edge of the disc seating member 15 is captured and held by bent portion 105 that has been formed at the bottom of the sidewall 104 of the upper housing 10 described above and the piston means 11, the piston guide member 12 that guides this piston means 11 in the direction of movement, the cap member 14, the disc seating member 15, the snap action disc 16 that has been arranged on top of the disc seating member 15, diaphragm 17 and O-ring 19 are assembled as a unit and placed in cavity 103 of the upper housing. Thus, fluid pressure can be applied to this sub-assembly and various tests of the inspection stage can be conducted without providing a contact mechanism of the switch.

In addition, the switch mechanism 30 comprising terminals 31 and 32, movable spring arm 34, operating arm 341 and movable contact 35 are assembled in another unit or sub-assembly in the lower housing 20 and can be separately tested as well.

Furthermore, by capturing and holding flange 201 of the top of lower housing 20 by the bent portion 154 of the sidewall 153 of disc seating member 15, lower housing 20 is attached to upper housing 10 and the contact mechanism of the switch mechanism 30 that has been sub-assembled in the lower housing 20 is operatively connected to the pressure sensing members that have been assembled in the upper housing 10.

Figure 7:
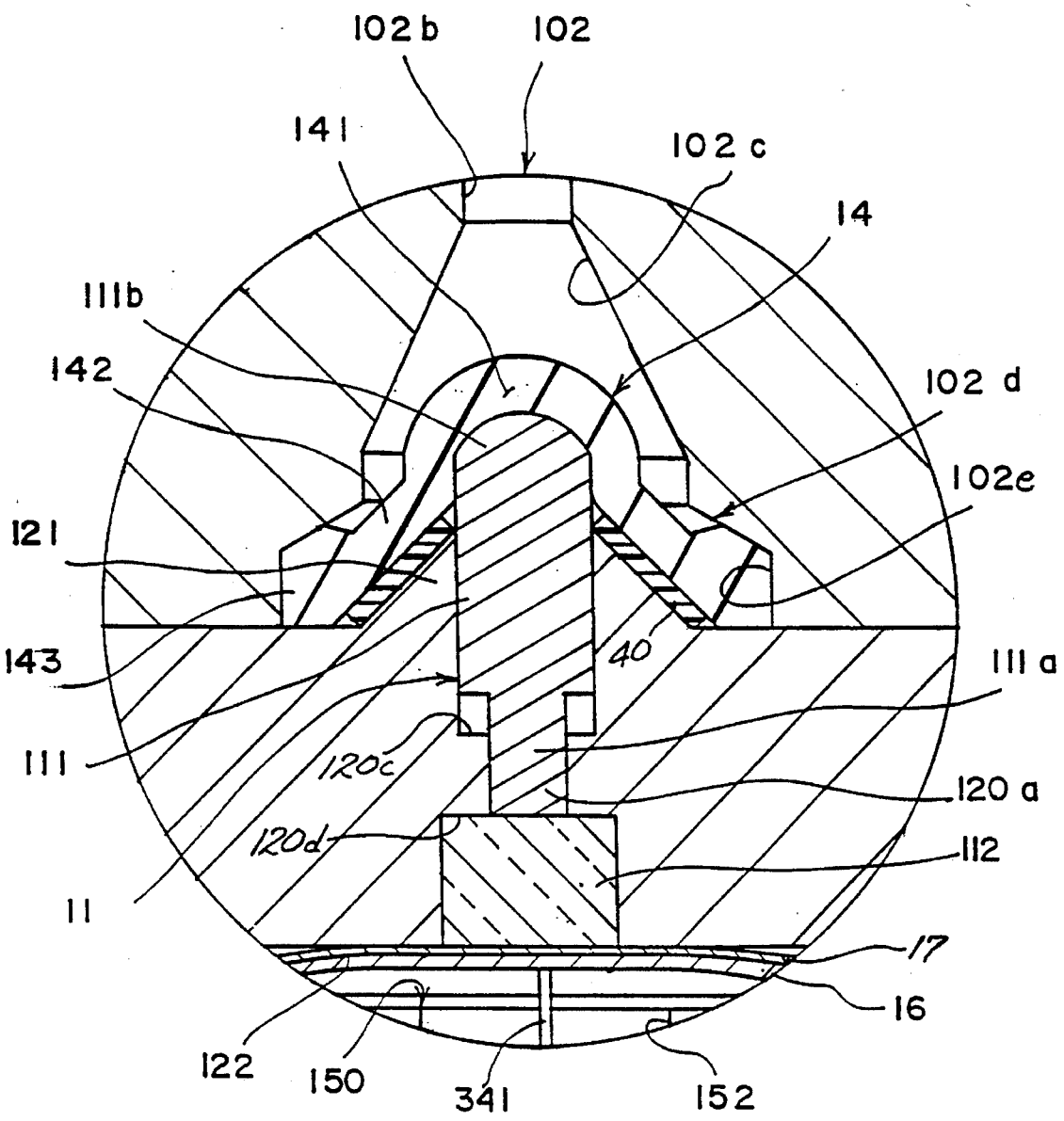
FIG. 7 is a view similar to FIG. 5, further enlarged, showing a modified embodiment of the invention.

FIG. 7 shows a modified embodiment of a pressure switch made according to this invention. FIG. 7 shows an annular member 40 made of low friction coefficient member such as PTFE, polytetrafluoroethylene, interposed between the inclined frusto-conical surface of the protuberance 121 on the piston guide member 12 and the inner surface of the intermediate region 142 of cap member 14.

According to the construction shown in this embodiment, it becomes possible, in connection with the sliding movement of the intermediate wall 142 of cap member 14 along the inclined surface of the frusto-conical protuberance 121 in accompaniment of the movement of piston member 111, to further reduce sliding friction between the piston and the intermediate wall 142 of the cap member 14 and, moreover, further minimize or prevent the phenomenon in which the cap member 14 tends to extrude into the gap between the guide hole 120 of the piston guide member 12 and the piston member 111.

Figure 8:
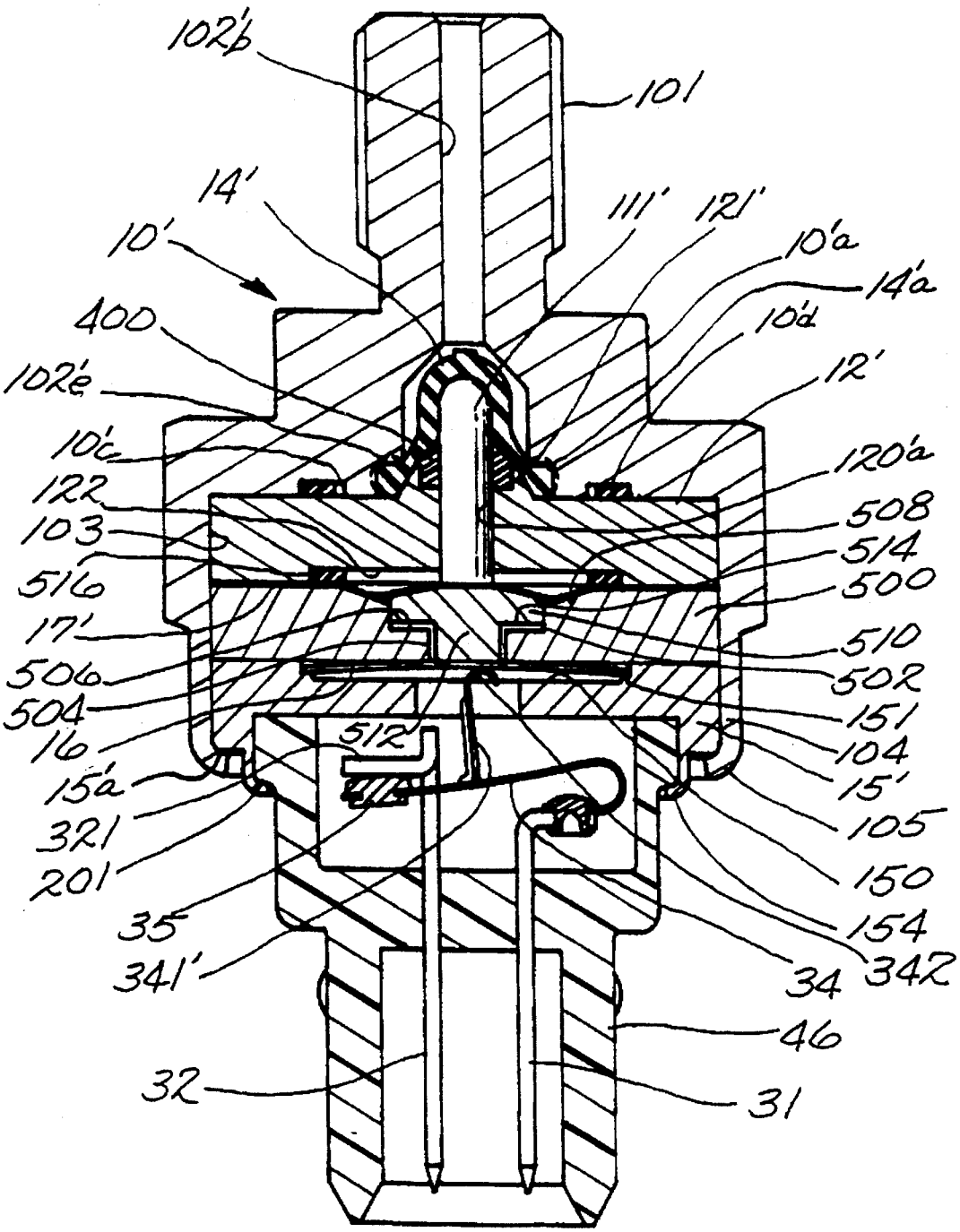
FIG. 8 is a view similar to FIG. 1 of a modified embodiment shown in the non-actuated condition and shown as a normally closed electrical switch.

With particular reference to FIG. 8 another embodiment of the invention is shown. Although either a normally open or a normally switch can be provided, as in the case of the previous embodiments, a normally closed switch is shown for purposes of illustration.

The pressure sensing portion of the switch housed in upper housing 10' utilizes a modified piston member 111' comprising a cylindrical body received in bore 120'*a* of piston guide member 12'. Frusto-conical protuberance 121' is formed with an annular ring seat 121'*b* (see FIGS. 9, 10) in communication with bore 120'*a* and which receives a ring member 400 to be discussed in greater detail below. Ring seat 121'*b* has an outer wall formed by the frusto-conical surface 121'*a* of protuberance 121' with a horizontal ledge 121'*c* formed at its top and with its bottom wall, or ring seat 121'*b* open to bore 120'*a*. Piston member 111' is slidingly received through bore 120'*a* and bore 402 of ring 400 and has its upper end received in cap member 14' and its lower end operatively connected to motion transfer member 510 through a flexible diaphragm 17'. Cap member 14' has a lower berm 14'*a* received in annular recess 102'*e* similar to berm 143 in recess 102*e* in the FIGS. 1, 2 embodiment. Cap member 14' has a generally cylindrical upper portion 14'*b* integrally attached to intermediate wall 14'c which flares outwardly to berm 14'a.

Ring member 400 is composed of material having sufficient flexibility so that it can maintain a positive inward radial force on the piston member and having low sliding frictional characteristics so that the piston member and cap member may glide smoothly past the ring member. The ring member material is also selected to have appropriate chemical resistance and thermal properties over a wide temperature range. A fluoroplastic such as PTFE, polytetrafluoroethylene, is an example of suitable material. Other materials such as nylon can be employed. If additional wear resistance is desired a filled PTFE can be employed. Additionally, a suitable lubricant compatible with the cap member material may be applied to the ring member and surrounding components.

Ring member 400 provides essentially a "zero clearance" fit between the piston member and its guide bore in the piston guide member to virtually eliminate the potential for extrusion of the cap member material into the gap which occurs between a piston and cylinder made in accordance with standard processing techniques. Ring member 400 has a generally cylindrical base portion 406 and an upper tapered surface 404 formed generally as a continuation of the frusto-conical surface of protuberance 121'. A shelf 405 extends radially outwardly from base portion 406 to the bottom of surface 404, and is adapted to be received on ledge 121'c when ring 400 is placed in ring seat 121'b.

Figure 11:
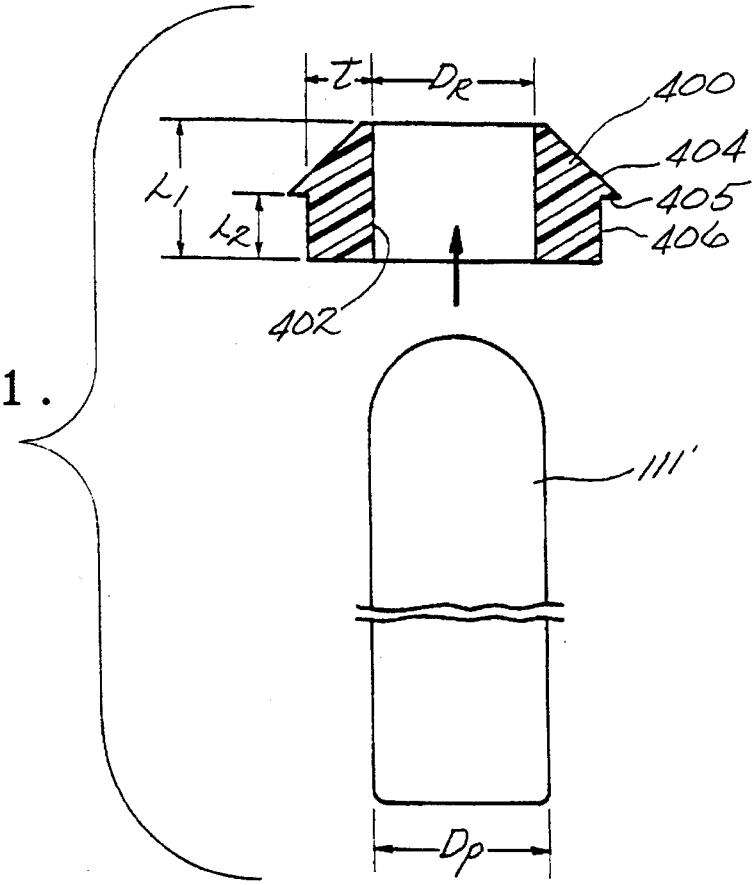
FIG. 11 is an enlarged blown apart view of a piston member and an extrusion preventing ring member.

A positive inward radial force, applied by the ring member to the piston member and necessary for maintaining zero clearance can be provided by means of an interference fit. As seen in FIG. 11, piston member 111' is selected having a diameter $D_P$ which is greater than the diameter $D_R$ of bore 402 which prestresses ring member 400 such that ring member 400 applies a radial force on the piston member achieving zero clearance. The ring member is press-fit over the piston member resulting in the preload. When using a heat-flowable material for the ring member the ring and piston members may be heated with the ring member conforming to the surface of the piston member with zero clearance.

Figure 9:
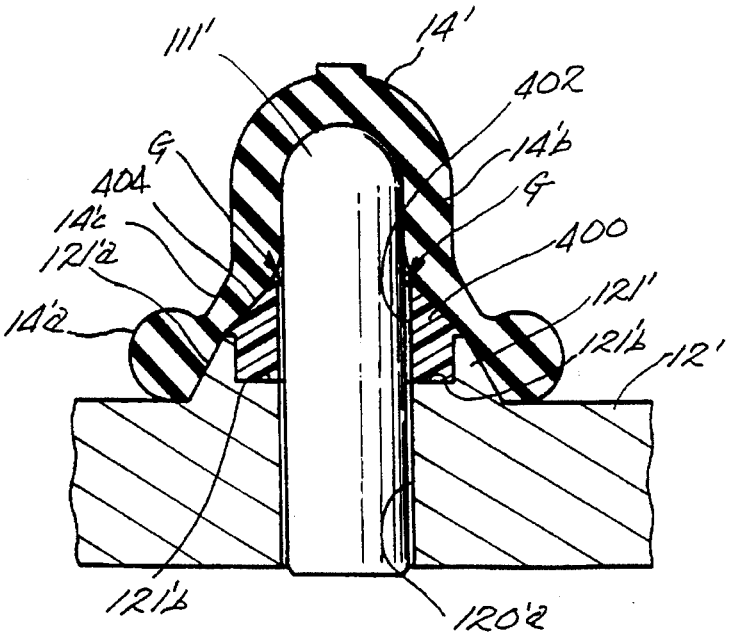
FIG. 9 is an enlarged view of the piston member/cap member portion of FIG. 8.
Figure 10:
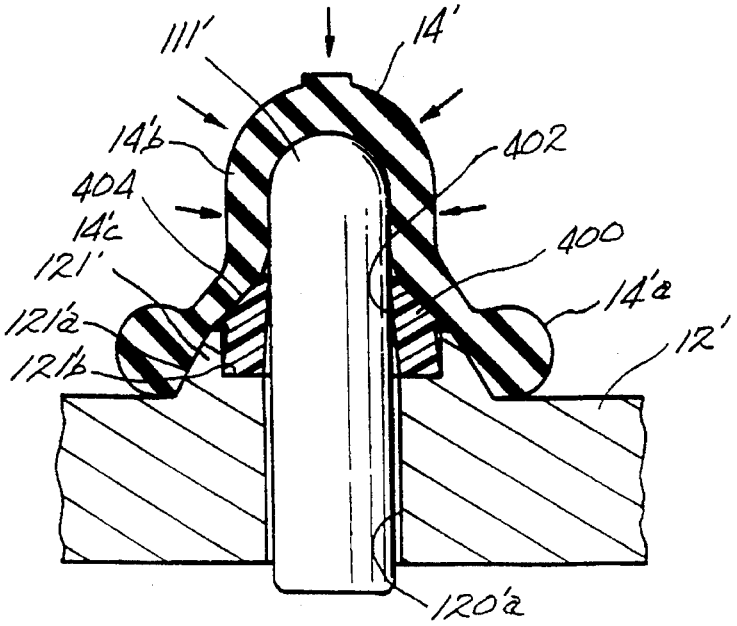
FIG. 10 is a view similar to FIG. 9 with the piston member/cap member shown in the actuated position.

An essentially zero clearance is also provided employing the embodiment of FIGS. 9 and 10. In this embodiment the diameter of bore 402 is selected to be essentially the same as bore 120'a of piston guide member 12' thereby providing a gap G between ring member 400 and piston member 111'. In the pressurized condition the upper tapered portion 404 flexes inwardly closing the gap between the inner diameter 402 of ring member 400 and piston member 111' from the position shown in FIG. 9 to that shown in FIG. 10. The dimensional parameters, shown in FIG. 11, the thickness t, the angle of the taper of surface 404, the height of the tubular portion $L_2$ and the overall height $L_1$ can be selected to attain optimum flexure for a given operating condition. Tubular portion $L_2$ may also be completely recessed in seat 121'b to achieve flexure on tapered surface 404 only thereby further controlling the ring member force on the piston member. This is particularly advantageous for minimizing ring member wear and for limiting piston member sliding resistance caused by ring member radial force. The tapered surface also provides the advantage that it serves effectively as a continuously smooth surface with the frusto-conical surface of protuberance 121' to thereby facilitate sliding movement of cap member 14' over the ring 5 member when the piston stroke occurs.

Figure 12A:
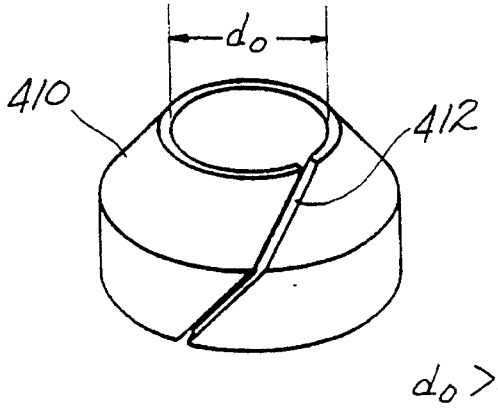
FIGS. 12(*a*) and 12(*b*) are perspective views of an alternate extrusion preventing ring member shown respectively in a condition where it is subjected to low pressure and a condition where it is subjected to high pressure.
Figure 12B:
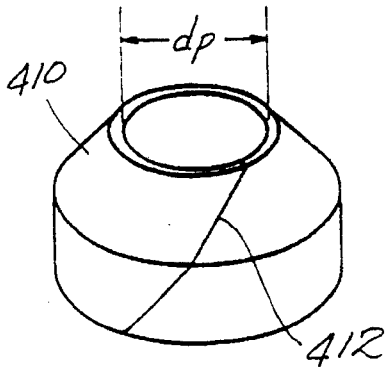

Yet another embodiment providing essentially zero clearance is shown in FIGS. 12a and 12b in which ring member 410 is split at 412 along a line inclined relative to the longitudinal axis so that under pressure the inner diameter of ring member 410 contracts closing the gap between it and the piston member.

Referring back to FIG. 8, motion transfer member 510 is slidably received in bore 502 of guide member 500. Bore 502 has a lower section 504 having a smaller diameter bore and forming a stop surface 506 which functions to prevent excessive force from being applied to snap action disc member 16 in the same manner as the stop surface 120c formed by bore 120a in FIGS. 1, 2 limits the stroke of piston member 111. Guide member 500 has a tapered recess 508 in its upper surface adjacent the bore 502 to minimize stresses in diaphragm 17'. An annular elastomeric sealing member 516 is disposed in recess 122 formed in the lower surface of piston guide member which cooperates with diaphragm 17' to prevent the flow of fluid therethrough. An annular recessed seal seat 10'c is provided around the fluid passageway in the bottom surface of body 10'a defining cavity 103' which receives a suitable annular sealing member 10'd. If desired, a suitable gasket 15'a is placed between the bent portion 105 of wall 104 and the bottom peripheral edge portion of disc seating member 15'.

Motion transfer arm 341' projecting upwardly from movable arm 34 is similar to arm 341 of the FIGS. 1, 2 embodiment but is provided with a curved distal end portion to provide a more consistent motion transfer between the disc member 16 and movable arm 34.

It will be noted that the redundant seal system provided by diaphragm 17', along with other components such as motion transfer member 510, serve to provide a fail safe mode of operation. In the event that the primary seal provided by diaphragm cap member 14' somehow fails and leakage occurs with fluid flowing into recess 122, the fluid pressure will act upon the upper surface of member 510, the diameter of which is chosen so that the pressure reaches a selected level, e.g., 3 MPa, disc 16 actuates to open the switch. For example, in a brake system the open switch can prevent further pump operation. As the brakes are used, pressure of the supplemental fluid stored in the accumulator of the system will decrease and when that pressure decreases to a selected level, e.g., 6 MPa, an alarm such as a pressure warning light can be actuated to warn the driver.

In view of the above, the following effects can be obtained by the pressure switch according to this invention:

(1) Since the sealing structure for the operating fluid is constructed by means of a cap member made of an elastomer, which is supported by a frusto-conical surface, the stress that is applied to the cap member at the time of a switching operation using high pressure fluid can be minimized, thereby realizing a long life for the pressure switch and offering a pressure switch of the high pressure type that ensures a switch action of high reliability.

(2) The provision of the intermediate wall of the cap member formed generally in the shape of an inverted V along with the frusto-conical surface of the protuberance and the movement of the piston member provides a bending motion of the cap member allowing relatively normal operation even with any possible hardening of the cap member in connection with use in low temperature environments thereby minimizing any adverse affect on switching set points. Therefore, even in low temperature environments, this pressure switch can be used with sufficiently high efficiency in its action.

(3) The cap member serves both as a member for transmitting fluid pressure to the piston head of the piston member and as a sealing member for preventing fluid flow from the operating fluid side to the pressure responsive member side. By adopting a construction wherein the actuation and movement of the pressure responsive disc member is directly transmitted to the spring arm of the switch mechanism, a separate motion transfer member is not required.

Because of this, the number of the component parts can be minimized and a pressure switch having a simple structure can be offered. In addition, it can eliminate the problem of wear due to the sliding of a conventional motion transfer member and the problem of contamination due to said wear.

(4) Even in the event where the operating fluid is a high pressure fluid, the surface area exposed to the fluid pressure that is transmitted to the piston member through the cap member can be reduced and the fluid pressure of the high pressure fluid can be converted into a relatively small switch driving force to be transmitted to the snap acting member.

(5) Since the pressure sensing members including the cap member can be sub-assembled as a separate unit in the upper housing, it becomes possible to separate and assemble the pressure action member side independently of the switch mechanism, thereby simplifying the manufacturing and assembling steps for the pressure switch. In addition, the unit of the pressure sensing member alone can be separated from the system of the switch mechanism and subjected to various tests in the inspection stage, thereby simplifying the inspection step.

(6) The provision of the ring member interposed between the frusto-conical support surface of the piston guide member and the cap member or around the piston member serves to reduce friction and to prevent extrusion of the cap member into the gap formed between the piston member and the piston member guide bore.

Though the invention has been described with respective to specific preferred embodiments thereof, many variations and modifications will immediately become apparent to those skilled in the art. It is therefore the intention that the appended claims be interpreted as broadly as possible in view of the prior art to include all such variations and modifications.

What is claimed:

1. A pressure switch comprising a housing, a piston member having a pressure receiving end and a force transmitting end movably mounted in a fluid passageway of the housing and being movable in response to fluid pressure received in the passageway, the housing having a wall defining a cavity, a piston guide member having a bore extending therethrough arranged in the cavity formed in the housing, the piston member received in the bore, a dished shaped disc member mounted in the housing adjacent the force transmitting end of the piston member, the disc member having opposite concave, convex dished configurations which actuates from a first configuration to a second configuration in dependence upon movement of the piston member and a switch mechanism coupled to the disc member, the switch mechanism comprises first and second terminals, the switch mechanism controlling the state of energization of a circuit between the first and second terminals in response to actuation of the disc member, a frusto-conical protuberance formed at the center of a surface of the piston guide member through which the bore extends, the protuberance having a base on the surface of the piston guide member, a cap member having an outer peripheral berm and having a central portion generally in the shape of an inverted U and which has a high elasticity is closely fitted to the protuberance of the piston guide member including the pressure receiving end of the piston member, the outer peripheral berm of the cap member being inserted into a recess formed in the wall of the housing adjacent to the protuberance to form a fluid seal between the fluid passageway and piston guide member and a ring shaped member having a low coefficient of friction interposed between the cap member and the inclined surface of the protuberance that that has been formed on the piston guide member.

2. A pressure switch according to claim 1 in which the cap member is made of a flexible material capable of following the movement of the piston member when the piston member moves in response to the rising and lowering of the fluid pressure and to elastically deform to conform to the shape of the pressure receiving end of the piston member and the frusto-conical surface of the protuberance of the piston guide member.

3. A pressure switch according to claim 1 in which the cap member has a head end face and an intermediate wall extends from the head end face at a selected angle forming a continuous smooth surface with the head end face, the head end face being curved generally in the shape of an inverted U that receives fluid pressure and transmits the fluid pressure to the pressure receiving end of the piston member, the intermediate wall slidingly moves toward the base conforming to the inclined surface of the frusto-conical shape of the protuberance in response to fluid pressure above a prescribed value, the intermediate wall extending to the outer peripheral berm.

4. A pressure switch according to claim 3 in which the length of the intermediate wall of the cap member is relatively long and the outer diameter of the outer peripheral berm is relatively small.

5. A pressure switch according to claim 1 in which the bore in the piston guide member has a first diameter along an upper portion of the bore and a second, smaller diameter along a lower portion of the bore and the piston has a lower portion having a diameter selected to be received in the lower portion of the bore in the piston guide member, a shoulder being formed on the piston member defining the lower portion so that the second, smaller diameter portion of the bore in the guide member limits travel of the piston.

6. A pressure switch according to claim 1 including a disc seating member mounted adjacent to the piston guide member and a diaphragm is interposed between the disc seating member and the piston guide member and a sealing member is disposed between the wall defining the cavity and the disc seating member forming a fluid seal on generally the entire surface of the diaphragm being in engagement with the surfaces of the disc member and the seating member during the period of the pressurized action of the fluid pressure.

7. A pressure switch according to claim 1 in which the switch mechanism includes a spring arm having a free distal end and an integrally formed operating arm extends upwardly therefrom to a free distal end, a stationary contact mounted on one of the first and second terminals at one end and a movable contact mounted on the free distal end of the movable arm movable into and out of engagement with the stationary contact, the free distal end of the operating arm being pressed against the center of the disc member, the movable spring arm being moved in dependence upon the movement of the operating arm when the disc member has actuated to the second configuration in response to the movement of the piston member, thereby moving the movable contact.

8. A pressure switch according to claim 1 in which the housing comprises an upper housing in which the cavity is formed and a lower housing that is provided under the upper housing, a pressure operating mechanism comprising the piston member, the piston guide member, the disc member, a disc seating member, and the cap member disposed as a single unit sub-assembled in the cavity of the upper housing and a switch mechanism which responds to the actuating motion of the disc member is provided within the lower housing and the lower housing with the switch mechanism being provided therein is attached to and fixed to the upper housing where the pressure operating mechanism has been assembled.

9. A pressure switch according to claim 8 further including a flexible diaphragm disposed between the disc member and the disc seating member and the piston guide member thereby shutting off fluid flow between the piston member and the disc member and a sealing member provided between a wall of the housing and the seating member.

10. A pressure switch according to claim 8 further including a wall depending downwardly from the upper housing, the wall being bent inwardly, the disc seat member having an outer periphery, the wall being bent to capture and hold the disc seating member, a peripheral wall part extending downwardly from the disc seating member, a flange protruding from the upper periphery of the lower housing, the peripheral wall being bent to capture the flange.

11. A pressure switch according to claim 1 in which an annular ring seating groove having a bottom wall is formed in the protuberance around the piston receiving bore for receiving said ring shaped member, the bottom wall of the groove being in communication with the bore.

12. A pressure switch according to claim 11 in which the groove is formed with an outer wall having an upper horizontal ledge extending to the tapered wall of the protuberance and the ring member is formed with a first diameter portion received in the seat and a second outwardly extending step received in the seat and a second outwardly extending step received on the ledge.

13. A pressure switch according to claim 11 in which the ring member has an inner diameter having the same diameter as the piston receiving bore.

14. A pressure switch according to claim 11 in which the piston member has an outer diameter and the ring member has an inner diameter having a smaller diameter than the outer diameter of the piston member.

15. A pressure switch according to claim 11 in which the ring member is formed with a slit therethrough to facilitate radial inward movement of the surface defining the bore.

16. A pressure switch comprising:

a housing forming a fluid passageway;

a diaphragm disposed in the housing extending across the passageway;

a piston member mounted to receive pressure of fluid in the passageway through the diaphragm, the piston member having an end face which is covered with the diaphragm;

a piston guide member having a piston receiving bore formed therethrough for guiding said piston member;

a ring member disposed about the piston member and between the diaphragm and the piston guide member so that the piston member can slide relative to the ring member, a frusto-conical surface is formed on the piston guide member around the piston receiving bore, the frusto-conical surface extending from a base up to an annular recess in the frusto-conical surface in communication with the bore, the ring member being formed of flexible material having a lower cylindrical portion received in the annual recess and an upper tapered surface generally in alignment with the frusto-conical surface, the piston member having a curved end face slidably received in the bore and diaphragm comprising a flexible cap received over the curved end face of the piston member, the tapered surface of the ring member and the frusto-conical surface, the cap member having an outer peripheral berm sealingly received in a recess formed in the housing around the passageway; and a switch member having first and second conductive members relatively movable into and out of engagement with each other in dependence upon movement of the piston member.

17. A pressure switch according to claim 16 in which the ring member has a piston receiving bore having a selected diameter and the piston member has a larger diameter selected to form an interference fit with the bore of the ring member.

18. A pressure switch according to claim 16 in which the ring member has a bore, the ring being split so that it can be compressed to form a smaller bore when the ring member is subjected to elevated fluid pressure in the passageway.

19. A pressure switch comprising a housing, a piston member having a pressure receiving end and a force transmitting end movably mounted in a fluid passageway of the housing and being movable in response to fluid pressure received in the passageway, the housing having a wall defining a cavity, a piston guide member having a bore extending therethrough arranged in the cavity formed in the housing, the piston member received in the bore, a dished shaped disc member mounted in the housing adjacent the force transmitting end of the piston member, the disc member having opposite concave, convex dished configurations which actuates from a first configuration to a second configuration in dependence upon movement of the piston member and a switch mechanism coupled to the disc member, the switch mechanism comprises first and second terminals, the switch mechanism controlling the state of energization of a circuit between the first and second terminals in response to actuation of the disc member, a disc seating member mounted adjacent to the piston guide member and a diaphragm is interposed between the disc seating member and the piston guide member and a sealing member is disposed between the wall defining the cavity and the disc seating member forming a fluid seal on generally the entire surface of the diaphragm being in engagement with the surfaces of the disc member and the seating member during the period of the pressurized action of the fluid pressure, a frustoconical protuberance formed at the center of a surface of the piston guide member through which the bore extends, the protuberance having a base on the surface of the piston guide member, a cap member having an outer peripheral berm and having a central portion generally in the shape of an inverted U and which has a high elasticity is closely fitted to the protuberance of the piston guide member including the pressure receiving end of the piston member, the outer peripheral berm of the cap member being inserted into a recess formed in the wall of the housing adjacent to the protuberance to form a fluid seal between the fluid passageway and piston guide member.

20. A pressure switch according to claim 19 in which the cap member is made of a flexible material capable of following the movement of the piston member when the piston moves in response to the rising and lowering of the fluid pressure and to elastically deform to conform to the shape of the pressure receiving end of the piston member and the frusto-conical surface of the protuberance of the piston guide member.

21. A pressure switch according to claim 19 in which the cap member has a head end face and an intermediate wall extends from the head end face at a selected angle forming a continuous smooth surface with the head end face, the head end face being curved generally in the shape of an inverted U that receives fluid pressure and transmits the fluid pressure to the pressure receiving end of the piston member, the intermediate wall slidingly moves toward the base conforming to the inclined surface of the frusto-conical shape of the protuberance in response to fluid pressure above a prescribed value, the intermediate wall extending to the outer peripheral berm.

22. A pressure switch according to claim 21 in which the length of the intermediate wall of the cap member is relatively long and the outer diameter of the outer peripheral berm is relatively small.

23. A pressure switch according to claim 19 in which the bore in the piston guide member has a first diameter along an upper portion of the bore and a second, smaller diameter along a lower portion of the bore and the piston has a lower portion having a diameter selected to be received in the lower portion of the bore in the piston guide member, a shoulder being formed on the piston member defining the lower portion so that the second, smaller diameter portion of the bore in the guide member limits travel of the piston.

24. A pressure switch according to claim 19 in which the switch mechanism includes a spring arm having a free distal end and an integrally formed operating arm extends upwardly therefrom to a free distal end, a stationary contact mounted on one of the first and second terminals at one end and a movable contact mounted on the free distal end of the movable arm movable into and out of engagement with the stationary contact, the free distal end of the operating arm being pressed against the center of the disc member, the movable spring arm being moved in dependence upon the movement of the operating arm when the disc member has actuated to the second configuration in response to the movement of the piston member, thereby moving the movable contact.

* * * * *